US006804483B2

(12) United States Patent
Yokoi et al.

(10) Patent No.: US 6,804,483 B2
(45) Date of Patent: Oct. 12, 2004

(54) ELECTROPHOTOGRAPHIC IMAGE FORMING APPARATUS AND PROCESS CARTRIDGES

(75) Inventors: Akiyoshi Yokoi, Shizuoka (JP); Kazushi Watanabe, Shizuoka (JP); Toshiyuki Karakama, Shizuoka (JP); Toru Oguma, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/091,285

(22) Filed: Mar. 6, 2002

(65) Prior Publication Data

US 2002/0131791 A1 Sep. 19, 2002

(30) Foreign Application Priority Data

Mar. 9, 2001 (JP) ..... 2001-066796

(51) Int. Cl.[7] ..... G03G 21/18; G03G 21/16

(52) U.S. Cl. ..... 399/113; 399/111

(58) Field of Search ..... 399/107, 109, 399/110, 111, 113

(56) References Cited

U.S. PATENT DOCUMENTS

| | | | | |
|---|---|---|---|---|
| 5,294,960 | A | 3/1994 | Nomura et al. | |
| 5,331,372 | A | 7/1994 | Tsuda et al. | |
| 5,404,198 | A | 4/1995 | Noda et al. | |
| 5,465,136 | A | 11/1995 | Watanabe | |
| 5,475,470 | A | 12/1995 | Sasago et al. | |
| 5,510,878 | A | 4/1996 | Noda et al. | |
| 5,583,613 | A | 12/1996 | Kobayashi et al. | |
| 5,623,328 | A | 4/1997 | Tsuda et al. | 399/111 |
| 5,659,847 | A | 8/1997 | Tsuda et al. | 399/113 |
| 5,689,772 | A | * 11/1997 | Fujiwara et al. | 399/113 X |
| 5,749,027 | A | 5/1998 | Ikemoto et al. | 399/113 |
| 5,774,766 | A | 6/1998 | Karakama et al. | 399/111 |
| 5,828,928 | A | 10/1998 | Sasago et al. | 399/111 |
| 5,878,304 | A | 3/1999 | Watanabe et al. | 399/92 |
| 5,884,124 | A | 3/1999 | Karakama et al. | 399/123 |
| 5,890,036 | A | 3/1999 | Karakama et al. | 399/119 |
| 5,899,602 | A | 5/1999 | Noda et al. | 399/111 |
| 5,920,752 | A | 7/1999 | Karakama et al. | 399/111 |
| 5,937,242 | A | 8/1999 | Yokoyama et al. | 399/114 |
| 5,940,658 | A | 8/1999 | Yokoi et al. | 399/119 |
| 5,966,566 | A | 10/1999 | Odagawa et al. | 399/109 |
| 5,966,568 | A | 10/1999 | Numagami et al. | 399/111 |
| 6,006,058 | A | 12/1999 | Watanabe et al. | 399/167 |
| 6,016,413 | A | 1/2000 | Yokoyama et al. | 399/113 |
| 6,029,032 | A | 2/2000 | Watanabe et al. | 399/111 |
| 6,070,028 | A | 5/2000 | Odagawa et al. | 399/167 |
| 6,075,956 | A | 6/2000 | Watanabe et al. | 399/92 |
| 6,097,909 | A | 8/2000 | Watanabe et al. | 399/111 |
| 6,144,398 | A | 11/2000 | Yokoyama et al. | 399/12 |
| 6,169,866 | B1 | 1/2001 | Watanabe et al. | 399/111 |
| 6,175,706 | B1 | 1/2001 | Watanabe et al. | 399/167 |
| 6,208,818 | B1 * | 3/2001 | Noda | 399/111 |
| 6,236,821 | B1 | 5/2001 | Yokoyama et al. | 399/113 |
| 6,246,849 | B1 | 6/2001 | Yokoyama et al. | 399/117 |
| 6,272,299 | B1 | 8/2001 | Numagami et al. | 399/111 |

FOREIGN PATENT DOCUMENTS

| | | | |
|---|---|---|---|
| JP | 10-240102 | * | 9/1998 |
| JP | 11-015354 | * | 1/1999 |
| JP | 2001-042753 | * | 2/2001 |

* cited by examiner

*Primary Examiner*—Sandra Brase
(74) *Attorney, Agent, or Firm*—Fitzpatrick, Cella, Harper & Scinto

(57) ABSTRACT

A process cartridge has an electrophotographic photosensitive drum, a developing member, a first frame for supporting the electrophotographic photosensitive drum, a second frame for supporting the developing member, a coupling pin for coupling the first frame to the second frame to be rotatable relative to each other, a first hole through which the coupling pin penetrates and which is provided in the first frame, a second hole into which the coupling pin is press-fitted and which is provided in the first frame, and a closed portion provided at a leading end of the coupling pin in a press fit direction in order to close the second hole.

17 Claims, 10 Drawing Sheets

ELECTROPHOTOGRAPHIC IMAGE FORMING APPARATUS AND PROCESS CARTRIDGES

BACKGROUND OF THE INVENTION

1. Field of the Invention

The present invention relates to process cartridges and electrophotographic image forming apparatus.

2. Description of the Related Art

The electrophotographic image forming apparatus described herein is an apparatus for forming an image on a recording medium by the electrophotographic image forming method. Examples of the electrophotographic image forming apparatus include, for example, electrophotographic copiers, electrophotographic printers (e.g., laser beam printers, LED printers, etc.), facsimile machines, word processors, and so on.

The process cartridges are cartridges in which at least developing means and an electrophotographic photosensitive drum are integrally built and which can be mounted onto or dismounted from the main body of an imaging forming apparatus. Further, process cartridges are cartridges in which at least cleaning means, charging means, and developing means as process means and the electrophotographic photosensitive drum are integrally built and which can be mounted onto or dismounted from the main body of the apparatus.

In the electrophotographic image forming apparatus using the electrophotographic image forming method, the electrophotographic photosensitive body uniformly charged by the charging means is subjected to selective exposure according to image information to form a latent image thereon.

Then the latent image is developed with toner by the developing means to form a toner image. Thereafter, the toner image formed on the electrophotographic photosensitive body is transferred onto a recording medium by the transferring means to form an image thereon.

The conventional image forming apparatus using the electrophotographic image forming process was constructed in the process cartridge system wherein the electrophotographic photosensitive body of drum shape and the process means acting on the electrophotographic photosensitive body were integrally built in a cartridge and this cartridge was mountable onto or dismountable from the main body of the image forming apparatus. This process cartridge system has permitted the user to perform the maintenance of the apparatus by himself or herself without any help from a service technician. Therefore, the process cartridge system enhanced operability remarkably. This process cartridge system is thus commonly used in the image forming apparatus.

A typical configuration of such process cartridges is such that two frames are coupled to each other. For example, a cleaning frame (first frame), which supports the photosensitive drum, the charging device, and the cleaning device, and another frame (second frame), which is a joint unit consisting of a developing frame for supporting the developing means and a toner frame having a toner chamber, are coupled to each other so as to be rotatable about a fulcrum. Then the two frames are biased around the fulcrum by elastic members such as springs or the like to determine relative positions of the photosensitive drum and the developing means. The functional advantages of the above structure include the optimization of pressure of the developing roller against the photosensitive drum, the capability of maintaining a clearance between the surface of the photosensitive drum and the surface of the developing roller, etc. and, on the other hand, the two-piece structure provides many merits of facilitating forming of the frames, facilitating assembly, and so on.

The present invention is a further development of the related art as described above. In the case of the conventional two-frame structure with coupling holes (through holes), there were cases where shavings of resin made during a press fit work of coupling pins to couple the two frames dropped into the interior of the process cartridge. This increased inconvenience in manufacturing, e.g., a need for an additional cleaning step in assembly.

SUMMARY OF THE INVENTION

An object of the present invention is to provide a process cartridge that is comprised of a first frame and a second frame and that can prevent shavings, made during press fitting of a coupling pin to couple the first frame to the second frame, from dropping through a press fit hole into the interior of the process cartridge.

Another object of the present invention is to provide a process cartridge that is comprised of a first frame and a second frame and that is configured to let air flow out of a press fit hole during press fitting of a coupling pin to couple the first frame to the second frame, thereby making the fastening force firm and secure with the coupling pin.

Another object of the present invention is to provide a process cartridge that is comprised of a first frame and a second frame and that is configured to prevent shavings, made during a press fitting of a coupling pin to couple the first frame to the second frame, from dropping through a press fit hole into the interior of the process cartridge and simultaneously to let air flow out of the press fit hole during the press fitting of the coupling pin, thereby making the fastening force firm and secure with the coupling pin.

Another object of the present invention is to provide a process cartridge and electrophotographic image forming apparatus comprising:

an electrophotographic photosensitive drum;

a developing member for developing an electrostatic latent image formed on the electrophotographic photosensitive drum, with toner;

a first frame for supporting the electrophotographic photosensitive drum;

a second frame for supporting the developing member;

a coupling pin for coupling the first frame to the second frame to be rotatable relative to each other;

a first hole through which the coupling pin penetrates and which is provided in the first frame;

a second hole into which the coupling pin is press-fitted and which is provided in the first frame; and a closed portion provided at a leading end of the coupling pin in a press fit direction in order to close the second hole.

Another object of the present invention is to provide a process cartridge and electrophotographic image forming apparatus comprising:

an electrophotographic photosensitive drum;

a developing member for developing an electrostatic latent image formed on the electrophotographic photosensitive drum, with toner;

a first frame for supporting the electrophotographic photosensitive drum;

a second frame for supporting the developing member;

an outside plate provided in the first frame and at an end thereof in an axial direction of the electrophotographic photosensitive drum;

an inside plate provided in the first frame and with a predetermined clearance to an inside surface of the outside plate;

an arm portion projecting from the second frame and interposed between the outside plate and the inside plate;

a coupling pin for coupling the first frame to the second frame to be rotatable relative to each other;

a first hole into which the coupling pin is press-fitted and which is provided in the outside plate;

a second hole of cylindrical shape into which the coupling pin is press-fitted and which is provided in the inside plate;

wherein an inside diameter of the first hole is greater than an inside diameter of the second hole;

a third hole, through which the coupling pin penetrates, for coupling the first frame to the second frame to be rotatable relative to each other, the third hole being provided in the arm portion;

a closed portion provided at a leading end of the coupling pin in a press fit direction in order to close the second hole; and an air hole provided in the closed portion, for discharging air inside the second hole when the coupling pin is press-fitted into the second hole.

DETAILED DESCRIPTION OF THE PREFERRED EMBODIMENTS

The embodiments of the present invention will be described below in detail with reference to the drawings.

A preferred embodiment of the present invention will be described next. In the following description, the transverse direction of the process cartridge B is a direction in which the process cartridge B is mounted onto or dismounted from the apparatus body 14, and it agrees with the conveying direction of the recording medium. The longitudinal direction of the process cartridge B is a direction intersecting (or approximately perpendicular to) the direction in which the process cartridge B is mounted onto or dismounted from the apparatus body 14, and a direction parallel to the surface of the recording medium and intersecting (or being approximately perpendicular to) the conveying direction of the recording medium. The left or the right directions for the process cartridge is defined as the left or the right in a top plan view of the recording medium as viewed along the conveying direction thereof.

Figure 3:
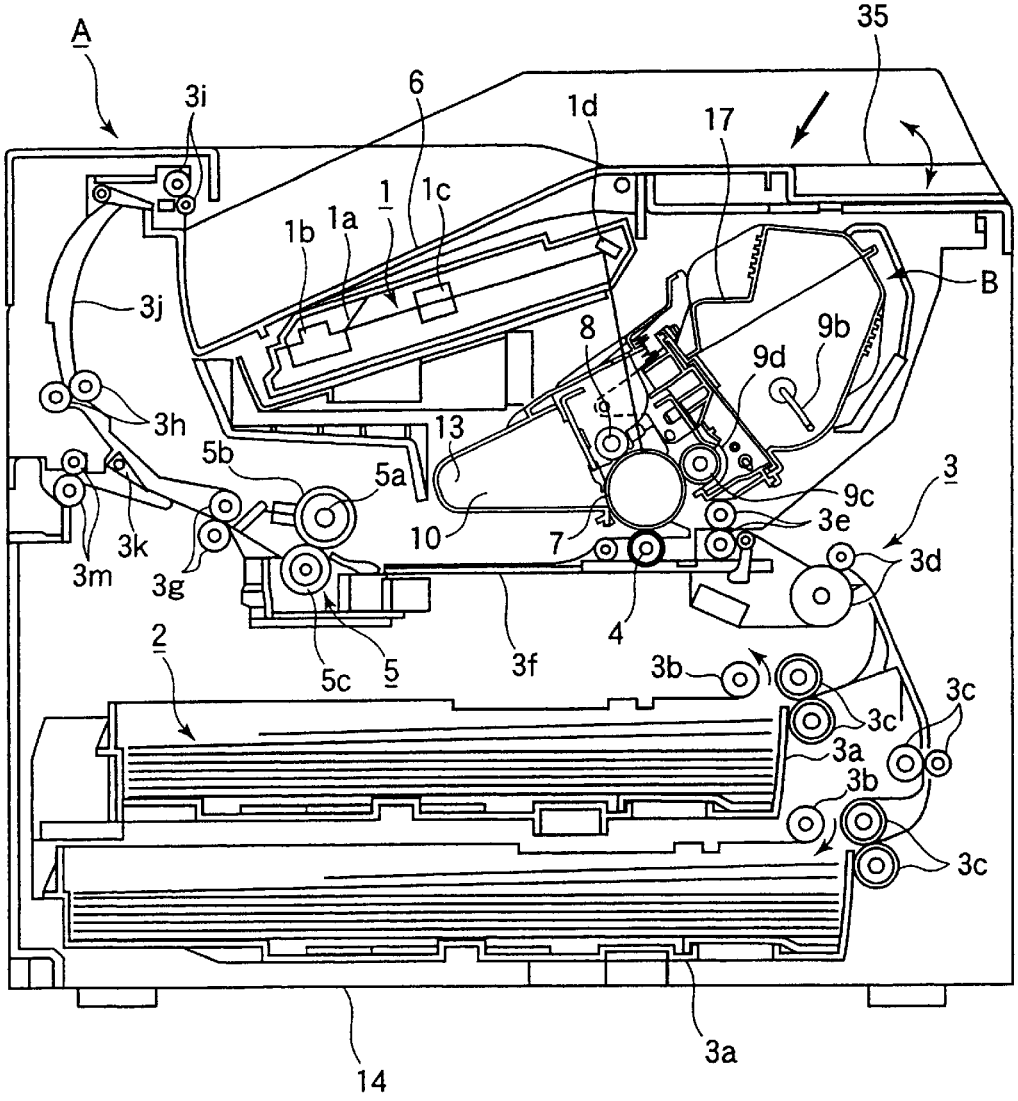
FIG. 3 is a vertical, sectional view of the main body of an image forming apparatus according to the embodiment of the present invention.
Figure 4:
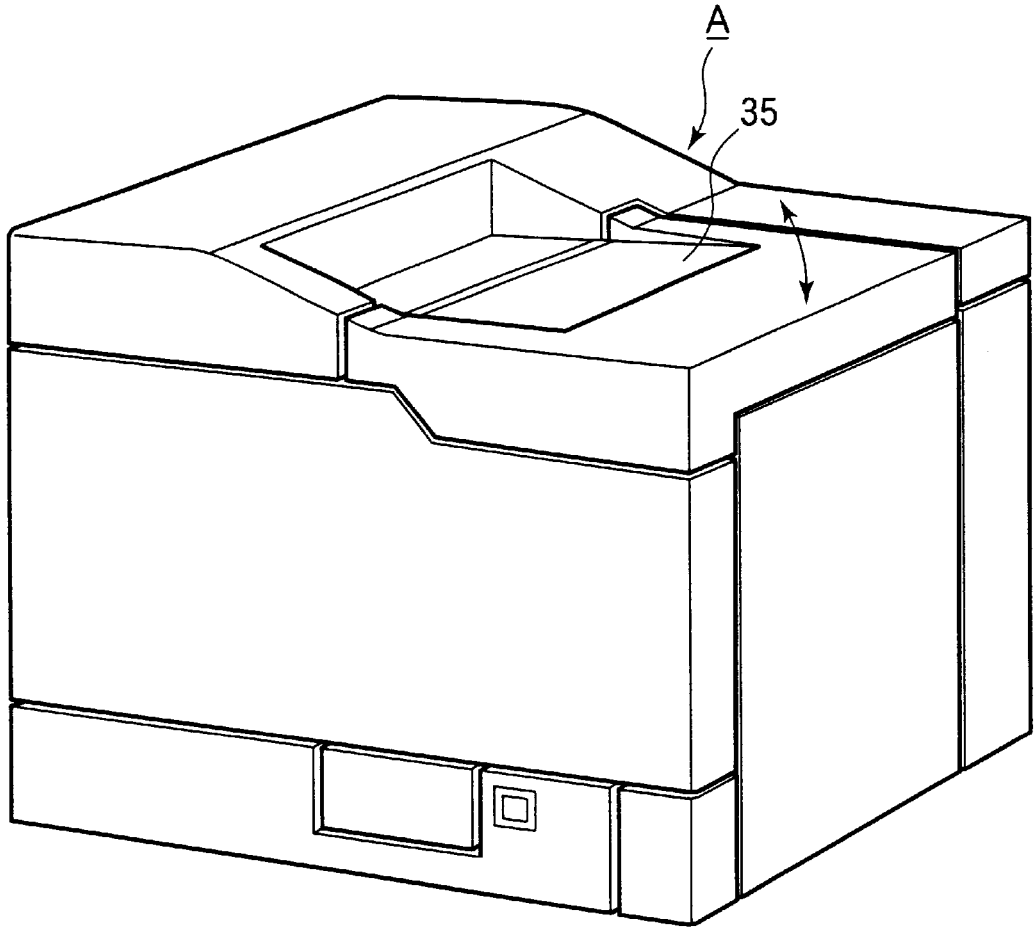
FIG. 4 is a perspective view to show the appearance of the main body of the image forming apparatus according to the embodiment of the present invention.

FIG. 3 is a schematic illustration of an electrophotographic image forming apparatus (laser beam printer) to which an embodiment of the present invention is applied, and FIG. 4 a perspective view showing the appearance of the apparatus. FIGS. 5 to 8 are drawings of the process cartridge to which the embodiment of the present invention is applied. In the following description, the upper surface of the process cartridge B is an upper surface in a mounted state of the process cartridge B on the apparatus body 14 and the lower surface is a lower surface in the mounted state.

(Electrophotographic image forming apparatus A and process cartridge B)

Figure 5:
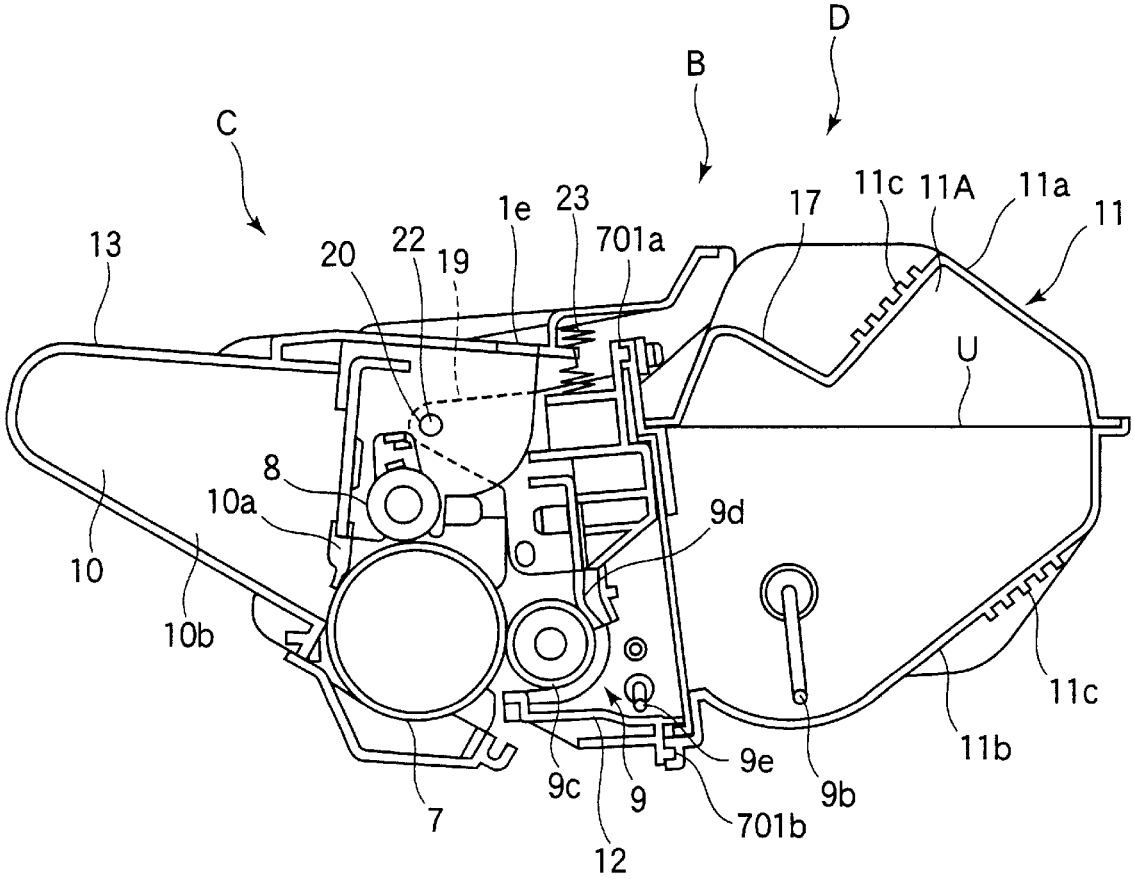
FIG. 5 is a vertical, sectional view of the process cartridge according to the embodiment of the present invention.

First described with reference to FIGS. 3 and 4 is the laser beam printer A as the electrophotographic image forming apparatus to which the embodiment of the present invention is applied. FIG. 5 is a sectional side view of the process cartridge B.

This laser beam printer A is an apparatus for forming an image on a recording medium (e.g., a recording sheet, an OHP sheet, a cloth, etc.) by the electrophotographic image forming process, as shown in FIG. 3. Then, a toner image is formed on an electrophotographic photosensitive body of a drum shape (which will be referred to hereinafter as a photosensitive drum). Specifically, the photosensitive drum is charged by charging means and then this photosensitive drum is exposed to laser light according to image information from optical means to form an electrostatic latent image according to the image information on the photosensitive drum. Then, this latent image is developed by developing means to form a toner image. In synchronism with the formation of the toner image, a recording medium 2 set on a sheet feed cassette 3*a* is conveyed by a pickup roller 3*b*, conveying roller pairs 3*c*, 3*d*, and a registration roller pair 3*e* as being reversed. Then, the toner image formed on the photosensitive drum 7 in the process cartridge B is transferred onto the recording medium 2 by applying a voltage to a transferring roller 4 as transferring means. After that, the recording medium 2 with the toner image thus transferred is conveyed to fixing means 5 by a conveyance guide 3*f*. This fixing means 5 consists of a driving roller 5*c*, and a fixing roller 5*b* incorporating a heater 5*a*. Then, the passing recording medium 2 is kept under heat and pressure to fix the transferred toner image thereon. Then this recording medium 2 is conveyed by sheet discharge roller pairs 3*g*, 3*h*, 3*i* to be discharged through a reversing path 3*j* onto a sheet discharge tray 6. This sheet discharge tray 6 is located in the top surface of the apparatus body 14 of the image forming apparatus A. It is also possible to discharge the recording medium 2 without passing the reversing path 3*j*, by actuating a rockable flapper 3*k* and guiding the recording medium by a pair of sheet discharge rollers 3*m*. In the present embodiment, the conveying means 3 is composed of the pickup roller 3*b*, the conveying roller pairs 3*c*, 3*d*, the registration roller pair 3*e*, the conveying guide 3*f*, the sheet discharge roller pairs 3*g*, 3*h*, 3*i*, and the sheet discharge roller pair 3*m*.

On the other hand, the process cartridge B is constructed, as shown in FIGS. 3 and 5, to rotate the photosensitive drum 7 and uniformly charge the surface thereof by application of a voltage to a charging roller 8 as charging means. Then the laser beam according to image information from the optical system 1 is guided through an exposure aperture 1*e* onto the photosensitive drum 7 to form a latent image thereon. Then this latent image is developed with toner by the developing means 9. Namely, the charging roller 8 is provided in contact with the photosensitive drum 7 to charge the photosensitive drum 7. This charging roller 8 rotates according to the rotation of the photosensitive drum 7. The developing means 9 supplies toner to a developing area of the photosensitive drum 7 to develop the latent image formed thereon. The optical system 1 consists of a laser diode 1*a*, a polygon mirror 1*b*, a lens 1*c*, and a reflecting mirror 1*d*.

Here the developing means 9 feeds the toner in a toner container 11A to the developing roller 9*c* by rotation of a toner feed member 9*b*. Then, the developing roller 9*c* with a stationary magnet built therein is rotated and a toner layer is formed on the surface of the developing roller 9*c* while being provided with triboelectric charge by a developing blade 9*d*. The toner is supplied to the developing area of the photosensitive drum 7. Then, the toner is transferred according to the latent image onto the photosensitive drum 7 to visualize the image as a toner image. Here the developing blade 9*d* functions to determine an amount of toner on the peripheral surface of the developing roller 9*c* and to provide the triboelectric charge. A toner agitating member 9*e* for circulating the toner in the developing chamber is rotatably mounted near the developing roller 9*c*.

Then, a voltage of an opposite polarity to that of the toner image is applied to the transferring roller 4 to transfer the toner image formed on the photosensitive drum, onto the recording medium 2. After that, residual toner on the photosensitive drum 7 is removed by cleaning means 10. The cleaning means 10 scrapes off the toner remaining on the photosensitive drum 7 by an elastic cleaning blade 10*a* kept in contact therewith, to collect it into a waste toner reservoir 10*b*.

Figure 6:
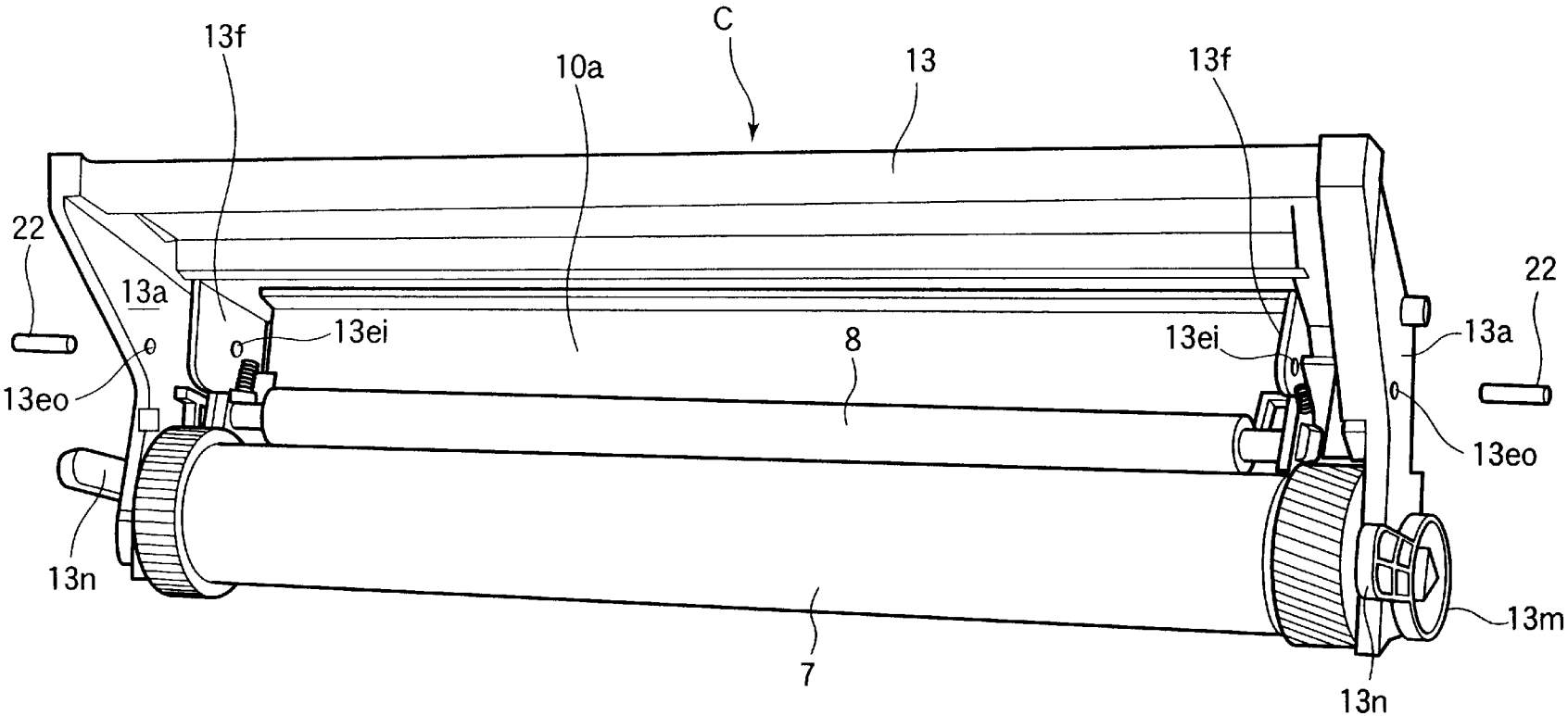
FIG. 6 is a perspective view showing a cleaning unit according to the embodiment of the present invention.

When an opening/closing member 35 provided at the right upper corner of the apparatus body 14 shown in FIG. 3 is opened about a fulcrum thereof, unrepresented guide rails can be seen in an obliquely installed state from the right upper part to the left lower part on the left and right sides in the right upper region of the apparatus body 14. On the other hand, as shown in FIG. 6, posture determining guides 13*n* of a long projection shape to be fitted in the guide rails are provided integrally with or separately from a circular guide 13*m* and a circular guide 13*m* to be fitted in positioning grooves provided at ends of the guide rails, on the left and right sides on a center line of the photosensitive drum 7 in the process cartridge B. Then, the circular guides 13*m* and posture determining guides 13*n* are put into the foregoing guide rails to mount the process cartridge B on the apparatus body 14.

For dismounting the process cartridge B from the apparatus body 14, the process cartridge B is lifted up in the direction from the left lower to the right upper, reverse to the above direction, to be taken out of the apparatus body 14.

During the mounting/dismounting work of the process cartridge B the user handles the cartridge by capturing ribs 11*c* in recess 17 of upper frame 11*a* and ribs 11*c* of lower frame 11*b* by hand. A toner frame 11 is composed of an upper frame 11*a* and a lower frame 11*b* integrally welded at joint surfaces U.

(Frame Structure of Process Cartridge)

Figure 2:
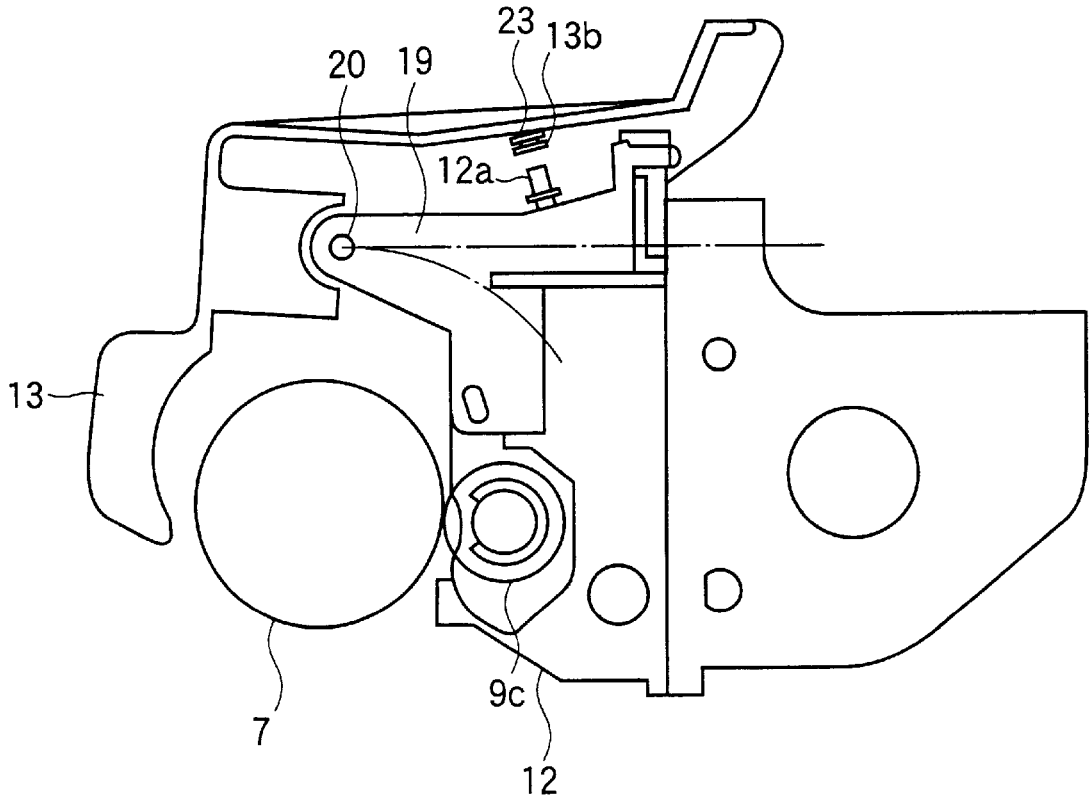
FIG. 2 is a vertical, sectional view showing the structure of a coupling part between frames of a process cartridge.

The process cartridge B according to the present embodiment is constructed by rotatably coupling a developing unit D to a cleaning unit C about a fulcrum at coupling pins 22; wherein the developing unit D is composed of a toner frame (second frame) 11 having a toner container (toner storage) 11A for storing the toner and a developing frame (second frame) 12 holding the developing means 9 including the developing roller 9*c* and others, which are joined by welding at portions 701*a*, 701*b*; and wherein the cleaning unit C is constructed by assembling the photosensitive drum 7, the cleaning means 10 including the cleaning blade 10*a* and others, and the charging roller 8 in a cleaning frame (first frame) 13. As shown in FIG. 2, the two ends of each of compression coil springs 23 are interposed between a spring stopper 13*b* of the cleaning frame 13 and a spring stopper 12*a* of the developing frame 12 as being set in a compressed state, whereby the cleaning frame 13 is biased counterclockwise about hang holes 20 while the developing frame 12 is biased clockwise, thereby urging spacer rollers 9*i* at the both ends of the developing roller 9*c* against the photosensitive drum 7.

(Method of Coupling Cleaning Frame to Developing Frame)

FIGS. 1, 2, 6, 7, and 8 show a method of coupling the cleaning unit C to the developing unit D. FIG. 6 shows the cleaning frame 13 and coupling pins 22.

Figure 7:
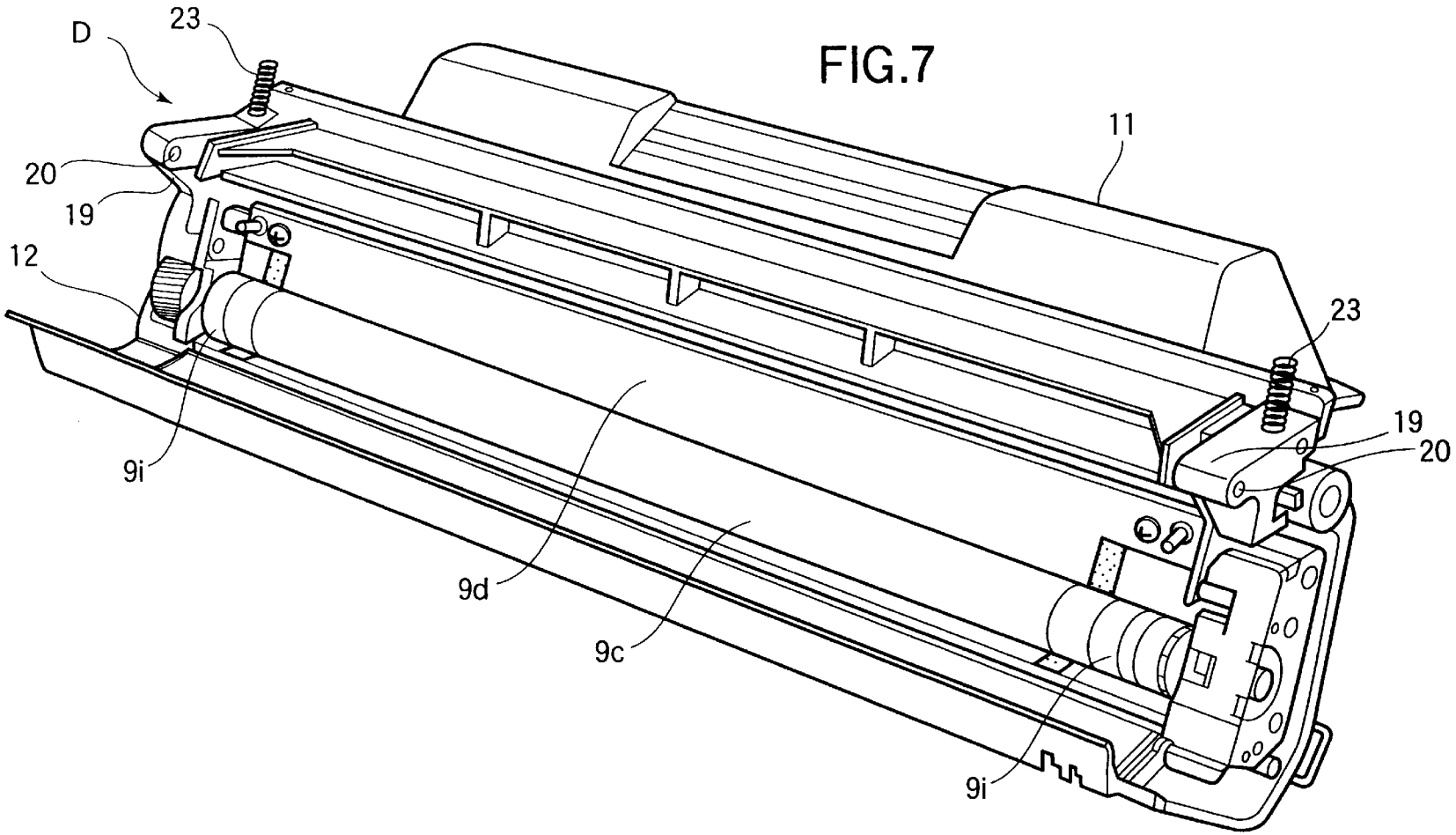
FIG. 7 is a perspective view showing a developing unit according to the embodiment of the present invention.
Figure 8:
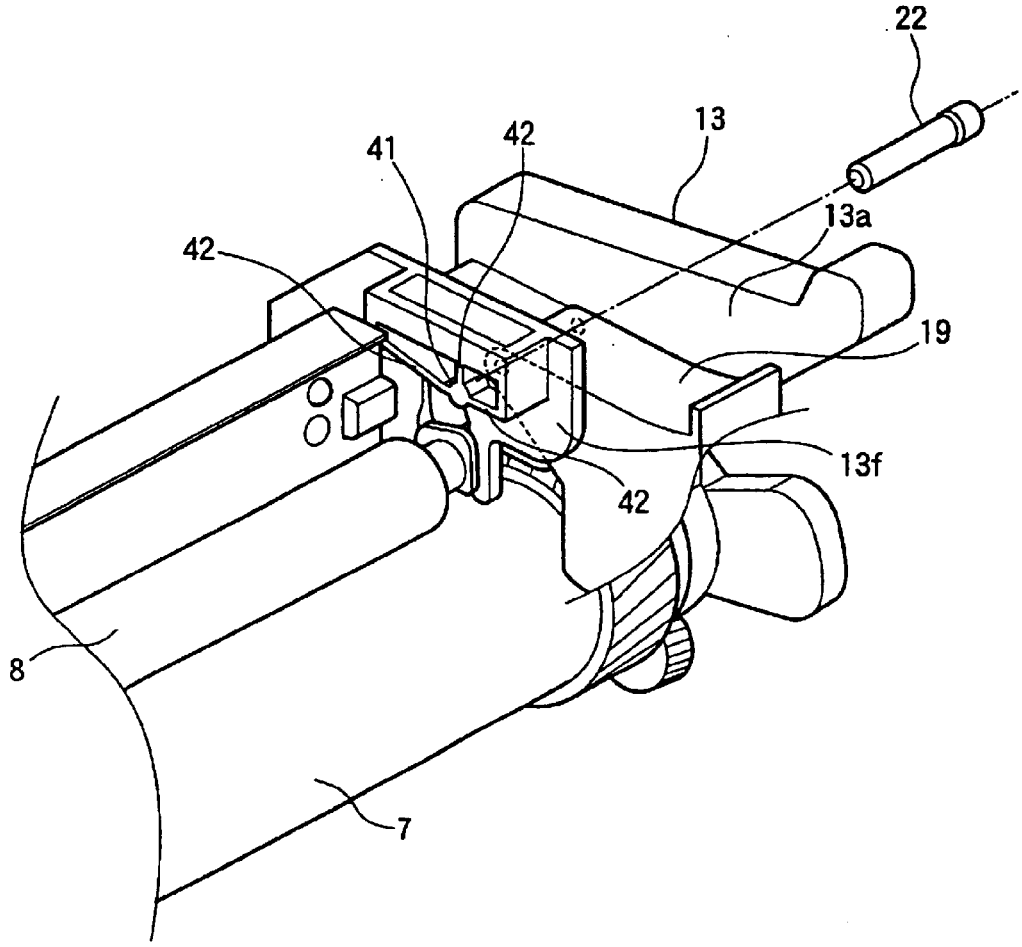
FIG. 8 is a perspective view showing the frame coupling part according to Embodiment 1 of the present invention.

As shown in FIGS. 2, 7, and 8, arm portions 19 project toward the cleaning frame 13 on the both sides in the longitudinal direction of the developing frame 12. The hang holes 20 are provided on the same axis and at the leading ends of the two arm portions 19 of the developing frame 12. Longitudinally outside plates 13*a* of the cleaning frame 13 are provided with their respective holes 13*eo* (first holes). Further, inside plates 13*f* for supporting the aforementioned charging roller 8 are placed with a clearance a little larger than the width of the arm portions 19 inside the outside plates 13*a*. The inside plates 13*f* are provided with their respective blind holes 13*ei* (second holes). The holes 13*eo* and the blind holes 13*ei* are aligned on a straight line in the longitudinal direction and are parallel to the photosensitive drum 7. The diameter of the holes 13*eo* is larger than that of the blind holes 13*ei*. A portion of each blind hole 13*ei* is provided with an air hole 41 and reinforcement ribs 42 as described hereinafter.

For coupling the cleaning frame 13 to the developing frame 12, the arm portions 19 of the developing frame 12 projecting toward the cleaning frame 13 are inserted into between the outside plates 13*a* and the inside plates 13*f* of the cleaning frame 13. Then the frames are positioned so that the support holes 13*e* (13*ei*, 13*eo*), and the hang holes 20 (third holes) of the developing frame 12 are approximately aligned on the same axis. After that, the coupling pins 22 are press-fitted into the holes from the outside of the both side faces of the cleaning frame 13. The coupling is effected by the relation of an interference fit between the outside diameter of the coupling pins 22 and the inside diameter of the support holes (13*eo*, 13*ei*) of the cleaning frame 13 and by the relation of clearance fit between the outside diameter of the coupling pins 22 and the inside diameter of the hang holes 20 of the developing frame 12. After completion of assembly, the developing frame 12 is rotatably supported around the coupling pins 22, while the coupling pins 22 engage the cleaning frame 13 under strength sufficient to resist a prescribed pulling force or higher.

Figure 1:
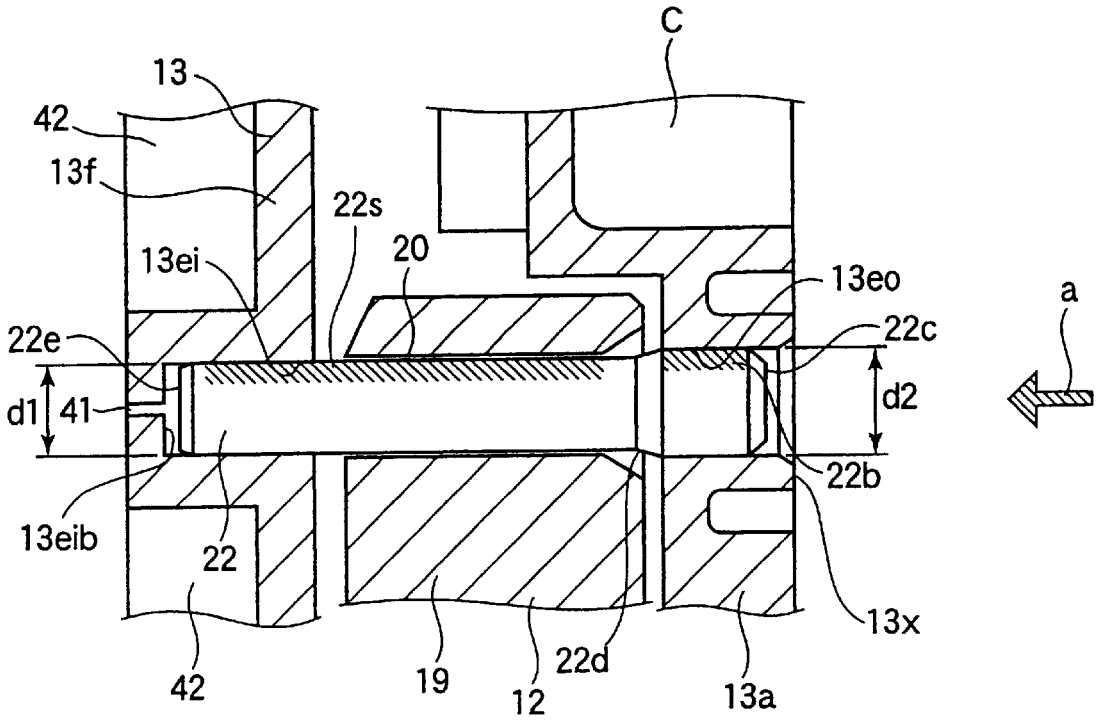
FIG. 1 is a transversely horizontal, sectional view of frame coupling part in Embodiment 1 of the present invention.

FIG. 1 is a sectional view showing the details of the coupling configuration with the coupling pins.

The coupling pins 22 are pins made of steel, such as stainless steel, or nonferrous metal, such as brass or the like, by cutting, grinding, or cold forging (cold forming). Each pin has a small diameter portion 22*s* (diameter d1) and a large diameter portion 22*b* (diameter d2) and a step portion 22*d* between them is connected by a taper. In the figure an arrow a indicates a direction of insertion of the coupling pin 22 and the illustrated state indicates an assembly complete state. Namely, each coupling pin 22 is inserted from the outside toward the inside of the side face of the cleaning frame 13.

In the present embodiment the dimensions are determined as follows in units of mm: the coupling pins 22 have the diameter of the small diameter portion 22*s*d1=ø3.0 (diameter of 3.0 mm) (tolerance: max 0, min −0.0015) and the diameter of the large diameter portion 22*b* d2=ø3.5 (JIS m8 tolerance: max +0.22, min +0.004); the blind holes 13*ei*, the holes 13*eo*, and the hang holes 20*a* have inside diameters not less than ø3.0 (tolerance: max −0.040, min −0.065), ø3.5 (tolerance: max −0.030, min −0.060), and ø3.0 (JIS E8 tolerance: max +0.028, min +0.014), respectively.

As a result, the coupling pins 22 are press-fitted into the cleaning frame 13 to be engaged by the interference fit between the small diameter portions 22*s* of the coupling pins and the support holes 13*ei* and between the large diameter portions 22*b* of the coupling pins and the support holes 13*eo*. On the other hand, since the hang holes 20 of the developing frame are kept in the clearance fit relation with the small diameter portions 22*s* of the coupling pins, the developing frame 12 is coupled so as to be rotatable about the coupling pins 22 as an axis. Since the present coupling method achieves the press fitting engagement at the two portions between the cleaning frame 13 and each coupling pin 22, the reaction against the pulling force on the pin increases to fasten the frame securely and firmly.

In this structure, a force necessary for drawing the coupling pin 22 out was measured by pressing the step portion 22*d* of the coupling pin 22 and the result was about 5 kgf (49N). This is a pull reaction sufficient to prevent a dropout of the pin in use of the process cartridge B.

On the other hand, the end of press fit of the coupling pin 22 is defined at a position where an end face 22*c* of the coupling pin 22 is located deeper than an end face 13*x* of a pin insertion port of the cleaning frame 13, as shown in FIG. 1. This is for the purpose of preventing the user from carelessly pulling the coupling pins 22 so as to separate the cleaning unit C from the developing unit D.

(Blind hole configuration of support holes)

The aforementioned blind hole configuration of the support holes 13*ei* will be described below in detail with reference to the sectional view of FIG. 1 and the perspective detail view of FIG. 8.

Each support hole 13*ei* in part of the inside plate 13*f* is formed toward the inside of the cleaning frame 13 in a blind hole shape. This structure prevents shavings, made by the coupling pin 22 during the press fit engagement of the coupling pin 22 in the aforementioned coupling step between the cleaning frame 13 and the developing frame 12, from dropping from the press fit part into the cleaning frame 13 or into the developing frame 12, and obviates the need for a special cleaning operation to remove the shavings.

The coupling pin 22 does not reach a bottom surface (closed portion) 13*eib* of the blind hole 13*ei*, while keeping a clearance between the bottom surface 13*eib* and the end face 22*e* of the coupling pin 22.

A fine air hole 41 of about ø0.1 to 1 mm penetrates the bottom surface 13*eib* of the blind hole 13*ei* along the direction parallel to the press fit direction of the coupling pin 22. This prevents compression of air inside the blind hole 13*ei* during the press fit engagement of the coupling pin 22 and thus prevents a force from acting in the pullout direction of the coupling pin 22. After the press fit engagement, the above structure prevents the pressure of air inside the blind hole 13*ei* from increasing because of temperature change and thereby prevents the coupling pin 22 from dripping out because of the force acting in a pullout direction of the coupling pin 22.

The hole diameter of the foregoing air hole 41 is preferably as small as possible, because fine shavings are prevented from dropping therethrough. Concerning the position of the air hole 41, in order to prevent the drop of shavings, it is preferable to position the air hole 41 above a horizontal line (in the mounted state of the process cartridge on the main body) passing the center of the hole. The present embodiment presented an example in which the foregoing air hole 41 penetrated the bottom surface in parallel to the press fit direction, but the air hole 41 does not always have to be parallel to the press fit direction as long as it penetrates the bottom surface so as to let the air inside the blind hole 13*ei* flow out thereof.

The reinforcement ribs 42 are provided on the opposite side to the press fit side of the inside plate 13*f* for supporting the aforementioned charging roller 8 and the blind hole 13*ei*. The provision of the ribs can prevent the inside plate 13*f* supporting the blind hole 13*ei* from being inclined during formation thereof. This structure can also prevent the inside plate 13*f* from being deformed by a force in the press fit direction during the aforementioned press fit engagement of the coupling pin 22, and thus can prevent decrease in the pressure of the charging roller 8 to cause charging failure. If the reinforcement ribs 42 are connected to the outer peripheral part of the blind hole 13*ei*, it is feasible to prevent the blind hole 13*ei* from being deformed in diameter expanding directions during the press fit engagement and thereby prevent an extreme drop of pull strength (fastening force).

Figure 9:
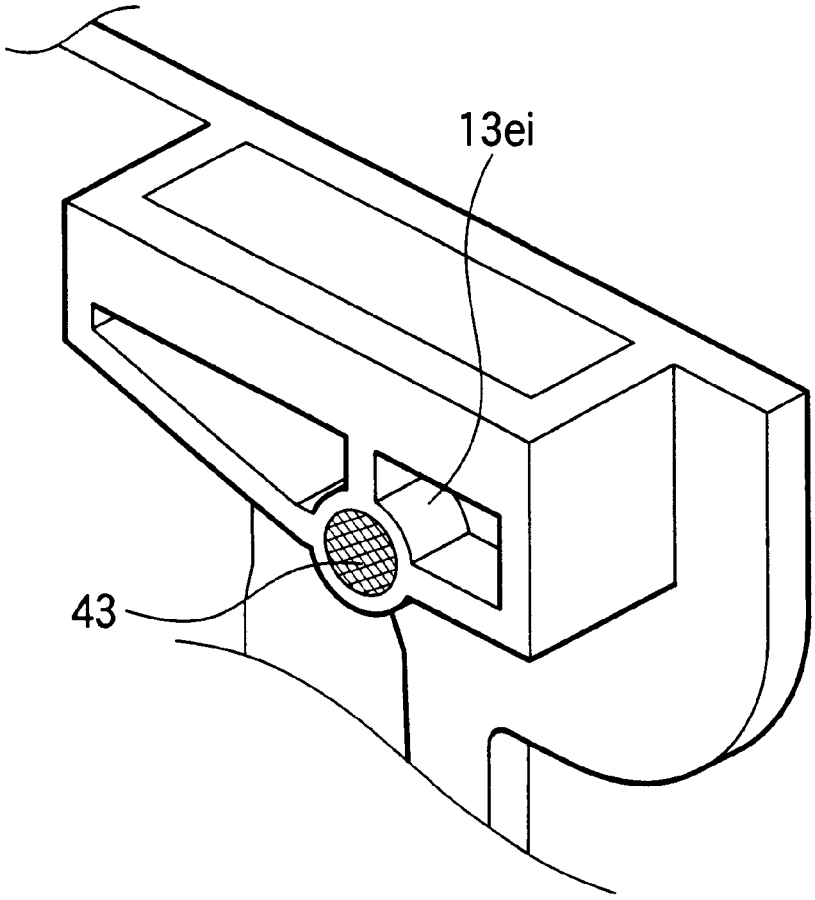
FIG. 9 is a perspective view to illustrate Embodiment 2 of the present invention.

As Embodiment 2 of the present invention, the air hole provided in the blind hole 13*ei* as an air vent during the press fit engagement as described above may be replaced by a mesh air hole 43 with a mesh being attached so as to close the bottom of the blind hole 13*ei*, as shown in FIG. 9. The same effect can also be achieved by attaching an air-permeable sheet to the hole. Namely, this structure prevents the shavings from dropping into the process cartridge and acts as an air vent.

Figure 10:
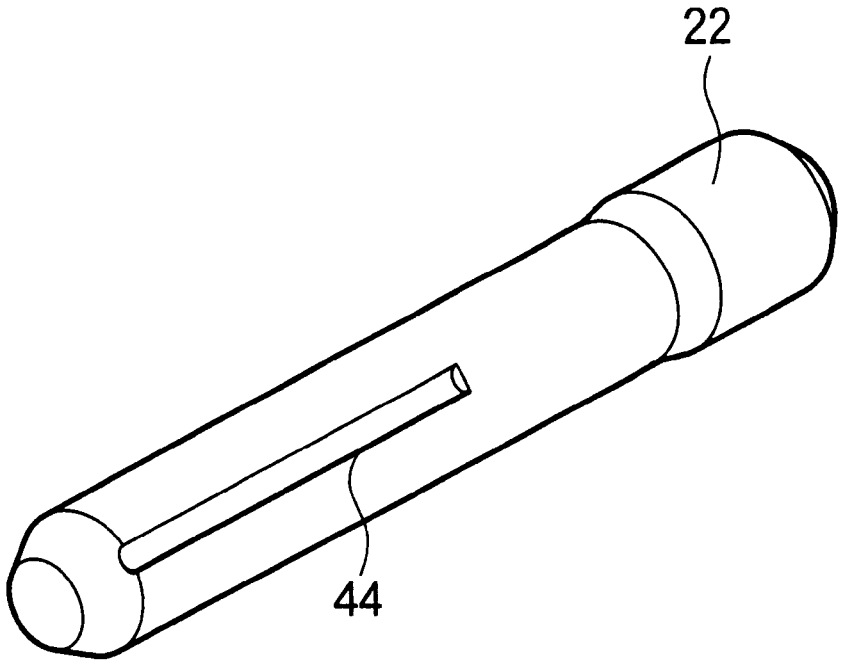
FIG. 10 is a perspective view to illustrate Embodiment 3 of the present invention.

As Embodiment 3 of the present invention, the foregoing air vent during the press fit engagement can also be substantiated by a configuration in which an air groove 44 is formed in the fitting part of the coupling pin 22, as shown in FIG. 10. and air is made to flow in the opposite direction to the press fit direction of the coupling pin 22. According to the same principle, the coupling part of the blind hole 13*ei* may be provided with a groove as an air vent.

As described above, the embodiments of the present invention provide the process cartridges that were comprised of the two frames (the cleaning frame C and the developing frame D) and that have a closed portion 13*eib* of the hole 13*ei* to prevent the shavings from the press fit hole 13*ei* from dropping into the interior of the process cartridge during the press fitting of the coupling pin 22 for coupling the two frames.

Since the air hole 41 is provided for letting the air flow out of the press fit hole 13*ei* during the press fitting of the coupling pin 22 for coupling the two frames, the fastening force with the coupling pin 22 can be made firm and secure.

Further, the embodiments of the present invention have permitted simultaneous implementation of the prevention of the drop of the shavings and the firm and secure fastening force with the coupling pin 22.

As described above, the present invention has permitted the process cartridge comprised of the first frame and the second frame to prevent the shavings from the press fit hole from dropping into the interior of the process cartridge during the press fitting with the coupling pin for coupling the first frame to the second frame.

Since the air is made to flow out of the press fit hole during the press t fitting with the coupling pin for coupling the first frame to the second frame, the fastening force with the coupling pin can be made firm and secure.

The present invention also made it feasible to prevent the shavings from the press fit hole from dropping into the interior of the process cartridge during the press fitting with the coupling pin for coupling the first frame to the second frame and simultaneously make the fastening force with the coupling pin firm and secure by letting the air flow out of the press fit hole during the press fitting operation.

What is claimed is:

1. A process cartridge detachably attachable to a main body of an electrophotographic image forming apparatus, comprising:

an electrophotographic photosensitive drum;

a developing member configured and positioned to develop an electrostatic latent image formed on said electrophotographic photosensitive drum with toner;

a first frame configured and positioned to support said electrophotographic photosensitive drum;

a second frame configured and positioned to support said developing member;

a coupling pin configured and positioned to couple said first frame to said second frame to be rotatable relative to each other;

a supporting portion, provided in said second frame, for engaging with said coupling pin so that said second frame is rotatable relative to said first frame;

a hole into which said coupling pin is press-fitted and which is provided in said first frame;

a closed portion provided in said hole to close a downstream side of said hole in a press-fit direction in which said coupling pin is press-fitted into said hole, and an air path configured to discharge air inside said hole to the outside of said hole when said coupling pin is press-fitted into said hole.

2. A process cartridge according to claim 1, wherein said hole is of cylindrical shape.

3. A process cartridge according to claim 1 or 2, wherein said air path is an air hole provided in said closed portion.

4. A process cartridge according to claim 3, wherein the diameter of said air hole is $\phi$0.1 to 1 mm.

5. A process cartridge according to claim 3, wherein said air hole is provided above a center of said hole in a mounted state of said process cartridge on the main body of the image forming apparatus.

6. A process cartridge according to claim 1 or 2, wherein said air path is provided in a side wall of said hole in the press-fit direction of said coupling pin.

7. A process cartridge according to claim 6, wherein said air path is a groove configured to discharge air inside said hole to the outside of said hole in an opposite direction to the press-fit direction.

8. A process cartridge according to claim 1 or 2, wherein said air path is a mesh hole provided in said closed portion.

9. A process cartridge according to claim 1 or 2, wherein said air path is a groove provided in said coupling pin to discharge air inside said hole to the outside of said hole in an opposite direction to the press-fit direction.

10. A process cartridge according to claim 1 or 2, wherein said coupling pin is press-fitted into said hole in an axis direction of said electrophotographic photosensitive drum, inward from the outside of said process cartridge.

11. A process cartridge according to claim 1 or 2, wherein said supporting portion is a through hole into which said coupling pin penetrates.

12. A process cartridge according to claim 11, wherein said coupling pin is press-fitted into said hole after passing through the through hole.

13. A process cartridge detachably attachable to a main body of an electrophotographic image forming apparatus, comprising:

an electrophotographic photosensitive drum;

a developing member configured and positioned to develop an electrostatic latent image formed on said electrophotographic photosensitive drum with toner;

a first frame configured and positioned to support said electrophotographic photosensitive drum;

a second frame configured and positioned to support said developing member;

an ouside plate provided in said first frame and at an end thereof in an axial direction of said electrophotographic photosensitive drum;

an inside plate provided in said first frame and with a predetermined clearance to an inside surface of said outside plate;

an arm portion projecting from said second frame and interposed between said outside plate and said inside plate;

a coupling pin configured and positioned to couple said first frame to said second frame to be rotatable relative to each other;

a first hole into which said coupling pin is press-fitted and which is provided in said outside plate;

a second hole of cylindrical shape into which said coupling pin is press-fitted and which is provided in said inside plate;

wherein the inside diameter of said first hole is greater than the inside diameter of said second hole;

a third hole, through which said coupling pin penetrates, configured and position to couple said first frame to said second frame to be rotatable relative to each other, said third hole being provided in said arm portion;

a closed portion provided in said second hole to close a downstream side of said second hole in a press-fit direction in which said coupling pin is press-fitted into said second hole; and an air hole provided in said closed portion, configured and positioned to discharge air inside said second hole to the outside of said second hole when said coupling pin is press-fitted into said second hole.

14. A process cartridge according to claim 13, wherein the diameter of said air hole is $\phi$0.1 to 1 mm.

15. A process cartridge according to claim 13, wherein said air hole is provided above a center of said second hole in a mounted state of said process cartridge on the main body of the image forming apparatus.

16. A process cartridge according to claim 13, wherein one end of said coupling pin is supported by said first hole and another end of said coupling pin is supported by said second hole.

17. An electrophotographic image forming apparatus for permitting a process cartridge to be detachably attached thereto and forming an image on a recording medium, said electrophotographic image forming apparatus comprising:

(i) a mount member configured and positioned to attach the process cartridge detachably, the process cartridge including: an electrophotographic photosensitive drum; a developing member configured and positioned to develop an electrostatic latent image formed on the electrophotographic photosensitive drum with toner, a first frame configured and positioned to support the electrophotographic photosensitive drum; a second frame configured and positioned to support the developing member; a coupling pin configured and positioned to couple the first frame to the second frame to be rotatable relative to each other; a supporting portion provided in the second frame for engaging with the coupling pin so that the second frame is rotatable relative the first frame; a hole into which the coupling pin is press-fitted and which is provided in the first frame; a closed portion provided in the hole to close a downstream side of the hole in a press-fit direction in which the coupling pin is press-fitted into the hole, and an air path configured to discharge air inside the hole to the outside of the hole when the coupling pin is press-fitted into the hole, and (ii) conveying means for conveying the recording medium.

* * * * *

UNITED STATES PATENT AND TRADEMARK OFFICE

CERTIFICATE OF CORRECTION

PATENT NO. : 6,804,483 B2
DATED : October 12, 2004
INVENTOR(S) : Akiyoshi Yokoi et al.

It is certified that error appears in the above-identified patent and that said Letters Patent is hereby corrected as shown below:

Column 9,
Line 12, “t” should be deleted.

Column 11,
Line 10, “toner,” should read -- toner; --

Column 12,
Line 8, “hole,” should read -- hole; --.

Signed and Sealed this

Eleventh Day of January, 2005

JON W. DUDAS
*Director of the United States Patent and Trademark Office*